United States Patent [19]

Ferguson

[11] Patent Number: 4,973,298

[45] Date of Patent: Nov. 27, 1990

[54] METHOD FOR MAKING A GUSSETED PLASTIC CONTAINER

[75] Inventor: Ronald A. Ferguson, Pictfield, Scotland

[73] Assignee: Ferguson Scot Limited, Ayrshire, Scotland

[21] Appl. No.: 327,970

[22] Filed: Mar. 23, 1989

[30] Foreign Application Priority Data

Mar. 29, 1988 [GB] United Kingdom ..... 8807379

[51] Int. Cl.[5] ..... B13B 45/00; B13B 1/66

[52] U.S. Cl. ..... 493/85; 493/211; 493/918; 493/947

[58] Field of Search ..... 493/85, 211, 338, 339, 493/918, 940, 947; 204/177.1, 177.17

[56] References Cited

U.S. PATENT DOCUMENTS 1,734,642 11/1929 Olm ..... 493/947
3,897,530 7/1975 Leathers ..... 264/285
4,540,390 9/1985 Thorschmidt ..... 493/23
4,586,917 5/1986 Robinson ..... 493/241
4,764,159 8/1988 Mitsuyama ..... 493/189

*Primary Examiner*—William E. Terrell
*Attorney, Agent, or Firm*—Krass & Young

[57] ABSTRACT

The invention relates to a method of producing containers such as envelope wallets and folders or the like, which comprise at least two outer wall components (4,6) margins of which are bonded on three sides of the wall components to edges of a flexible extruded plastics material strip (12) which in the example given is polyvinyl chloride, and which has a V-cross-section or a W-cross-section and forms an insertor gusset. The container may have at least one interior wall component provided with adjacent inserts (12) bonded to neighboring wall components. Dielectric heating may be used for the bonding step and suitable apparatus is also described.

6 Claims, 5 Drawing Sheets

METHOD FOR MAKING A GUSSETED PLASTIC CONTAINER

This invention is concerned with improvements in or relating to containers of plastics material, particularly but not exclusively for use for example as folders, wallets or other envelope packaging for paper or other sheet materials.

Containers of the above type may be of any design but a typical document folder comprises a pocket formed of folded sheet material, joined along appropriate margins and having a flap covering the mouth of the pocket. If more than a few sheets of paper are required to be contained therein, an expandable device such as a folded gusset is incorporated in the joined margins to permit an increase in the internal volume of the container.

While gusseted containers are readily made from paper products, being cut from thin card and assembled by glueing and taping as necessary, problems have been encountered in attempts to produce all but the simplest folders or wallets from p.v.c. sheet material. The problem is principally one of the provision of the folded gusset from a material which, unlike paper, does not readily take a permanent crease, and therefore in use or during assembly soon reverts to the as-formed condition causing the folder to assume an unattractive appearance.

The invention provides a method of producing containers for use in enveloping or packaging contents comprising the steps of procuring container wall components comprising sheet plastics material, arranging the components so that selected marginal portions are in substantial alignment, but spaced apart from one another by a distance, procuring an insert formed from a strip of flexible extruded plastics material, said strip having a V-shaped or W-shaped cross-section corresponding to a V-shaped or W-shaped orifice of an extrusion die, and securing outer lengthwise extending margins of portions of said strip to the selected marginal portions of the wall components by a bonding technique to form a gusset.

By the term "W-shaped cross-section" is included a cross-section resembling a zig-zag shape having at least three changes of direction therein.

Conveniently, the thickness or formulation of the plastics sheet material forming the wall components is such that the latter are less flexible than the extruded strip.

Conveniently, closure means may be incorporated in the containers wall components, for example, a flap or sliding fastener of plastics material, the closure means being added prior to the bonding of the extruded strip.

There will now be described in detail an example of a container according to the invention. It will be understood that the description which is to be read with reference to the drawings is given by way of example only and not by way of limitation.

In the drawings:

FIGS. 1, 5 and 6 are perspective views of containers in the form of document wallets;

FIGS. 2,3, 4*a* and 4*b* are fragmentary sectional views of alternative arrangements of components of containers according to the invention;

Figure 1:
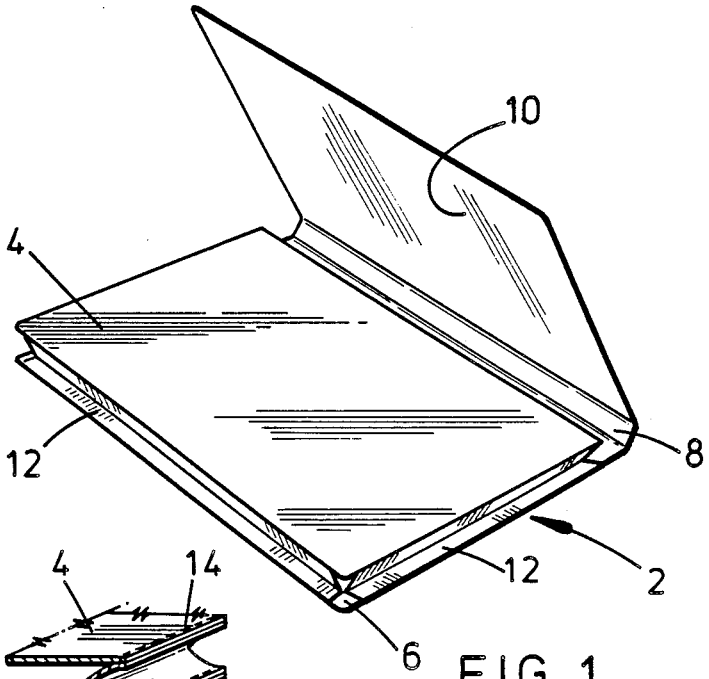
Figure 2:
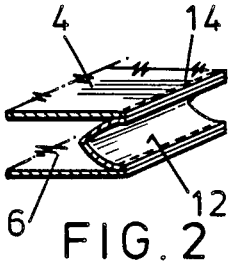
Figure 3:
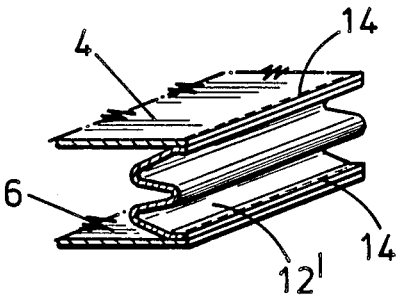

An example of a container according to the invention is shown in FIG. 1, which illustrates a document wallet 2 comprising wall components in the form of a front panel 4, a rear panel 6, a hinge zone 8, a flap 10 and three flexible gusset strips 12 (two shown). The strips 12 are formed from flexible extruded polyvinyl chloride (pvc) in the present example. The thickness is in the range 0.010–0.020 inch (0.25–0.51 mm). Such pvc material has a strong tendency to return to its original shape, i.e. it has a "memory". Thus the desired pleats or folds in the gusset strip are preformed by extrusion through dies having a V-shaped orifice to produce the strip 12 of FIGS. 1 and 2, or a W-shaped orifice to produce the strip 12' of FIG. 3.

In either case, lengthwise marginal edges of the strips 12,12' are welded at 14, in the present example by dielectric heating (RF energy), to corresponding marginal portions of the panels 4 and 6.

Figure 4:
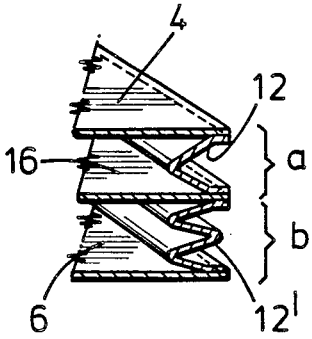

FIG. 4 shows a multiple arrangement in which an intermediate panel 16 is provided to give a wallet having double pockets. The strips which are welded to the panels 4, 16, 6 may be V-shaped as at FIG. 4*a* or W-shaped as at FIG. 4*b*.

Figure 5:
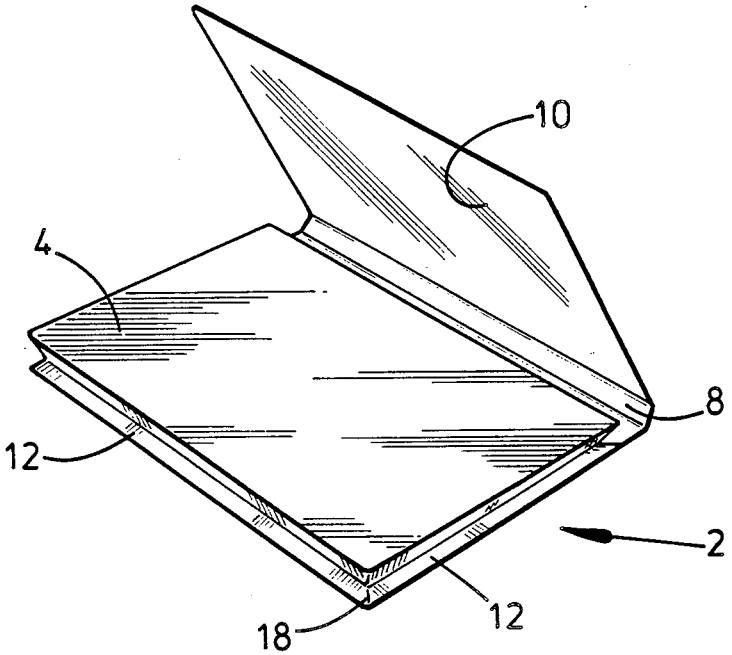
Figure 6:
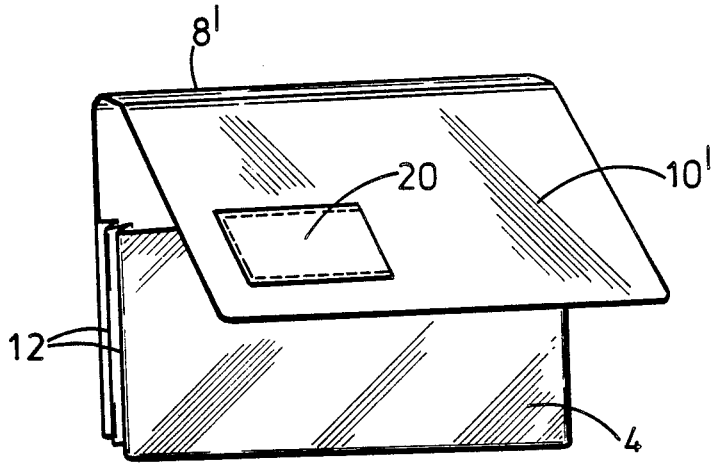

FIG. 5 shows an alternative example of container having pre-welded seams 18 provided at corner portions of the strip 12. FIG. 6 shows another alternative example having an insert of flexible plastics material forming a hinge zone 8'. A portion of transparent plastics sheet materials forms a pocket 20 on the flap 10' thereof.

Figure 7:
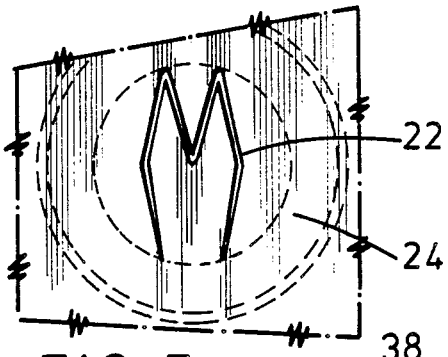
FIG. 7 shows an extrusion die orifice.
Figure 8:
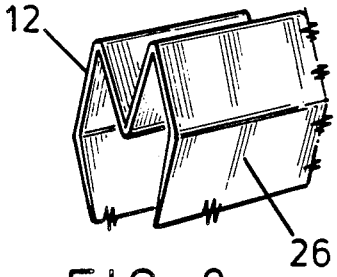
FIG. 8 is a perspective view of a flexible strip of plastics material.

All the examples incorporate flexible strips 12 and the following description relates to the manufacture and assembly of a document wallet having a W-section strip 12. The strip 12 is formed by the extrusion through an orifice 22 in an extrusion die 24 (FIG. 7) of a polyvinyl chloride plastics material having a hardness of $93 \pm 2$ on the SHORE scale and having memory-retaining properties. The orifice 22 allows a strip to be formed with excess material 26 on the outer edges thereof. This excess is trimmed as described later and its initial presence ensures that the trimmed edges are accurately formed so that a satisfactory welded seam may be obtained.

It will be understood that the extrusion operation will be carefully temperature-controlled in a conventional manner to ensure the pvc material achieves a set condition before any distortion occurs.

Figure 9:
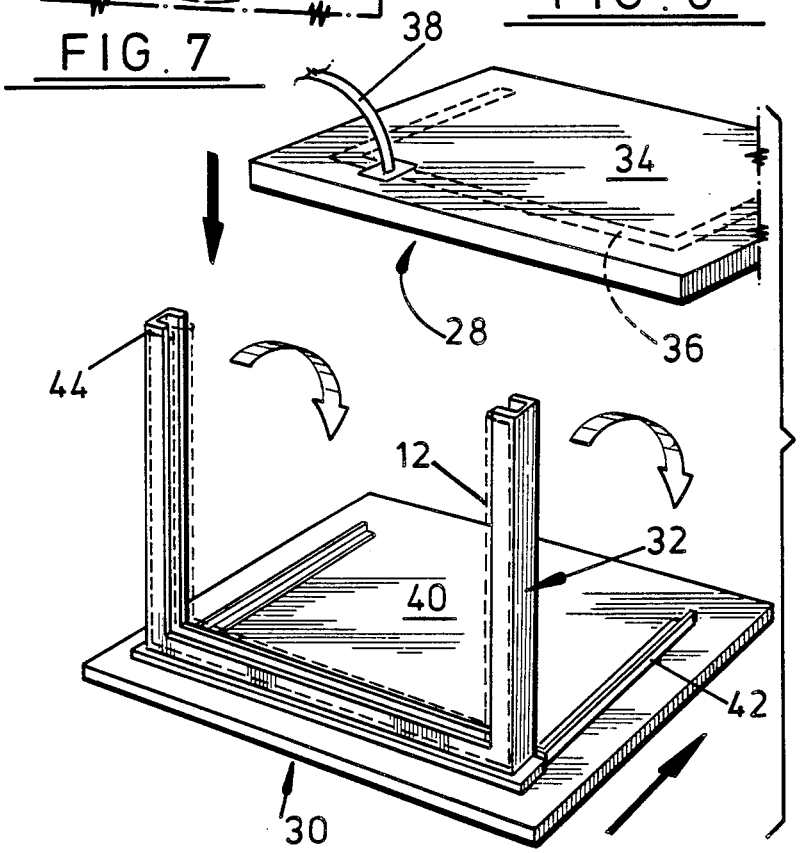
FIG. 9 is a diagrammatic view (not to scale) of apparatus for carving out the method of the invention.
Figure 10:
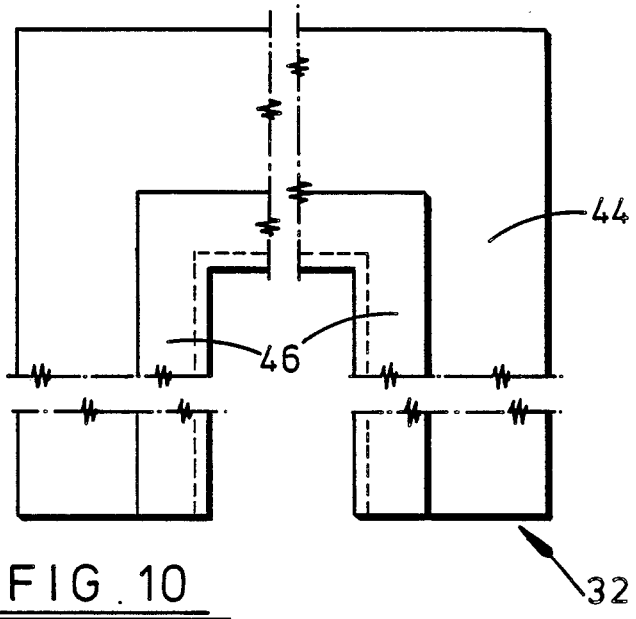
FIGS. 10 and 11 show a strip holder.
Figure 11:
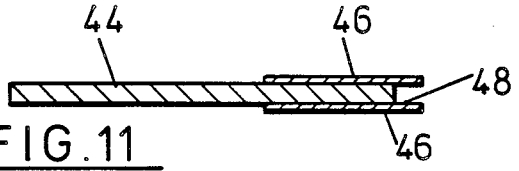

In FIG. 9 is illustrated on upper welding tool 28, a lower welding tool 30 and a support frame 32 for a W-section section strip 12, shown in its loading position.

Figure 12:
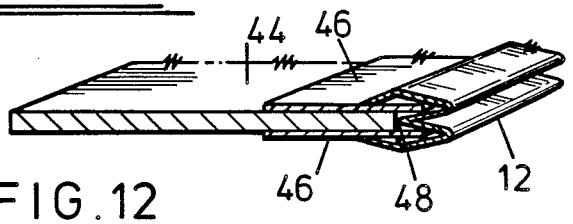
FIG. 12 shows the strip in place in the holder.

The upper welding tool comprises a top plate 34 on which is mounted a brass tool 36 to which a r.f. feed strip 38 is attached. The lower tool 30 comprises a bottom plate 40 on which is mounted a brass tool 42, which is grounded. Diagrammatically illustrated in its loading position is the support strip support frame 32 having a strip 12 shown thereon in broken lines. As may be seen from FIGS. 13–12, the frame 32 comprises a C-shaped member 44 inner edges of which support a pair of support portions 46 between which is thus formed a groove 48 into which is received the central portion of the strip 12 (FIG. 12), the frame 32 being then swung through 90° into its operative position.

Figure 13:
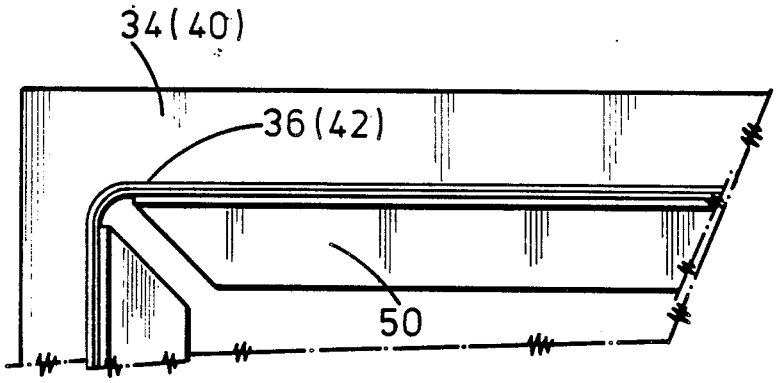
FIG. 13 is a fragmentary view of a top or bottom weld plaste.
Figure 14:
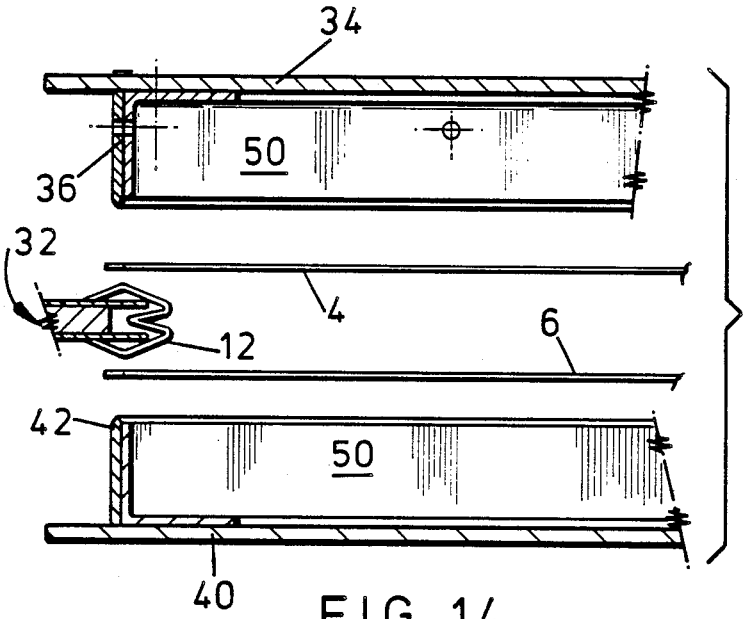
FIG. 14 shows the apparatus of FIG. 9 in operative condition.

FIG. 13 shows the brass welding tools 36 or 42 in detail. The brass tool is in each case supported by an aluminium angle piece 50 and is set on the associated plate in a configuration corresponding to the margin of the wallet assembly to be welded.

The lower plate is then moved to a position immediately between the raised top plate which latter is then lowered, a potential difference (in the present example 20,000 v at 45 MHz) is then applied to form a bond between the heated plastics portions and the bonded seams are then trimmed.

It will be understood that the heating will be carefully controlled in a conventional manner taking into account area and thickness of the material of the wallet components, so as to bring the material to a temperature high enough to provide the softening required for welding but not so great as to produce distortion.

Various modifications may be made with the scope of the invention as defined in the following claims. For example, the bond may be formed, if preferred, by ultrasonic welding of the plastics sheets. Alternatively the bonding technique may involve the use of adhesives or plastics cements.

I claim:

1. A method of producing containers for use in enveloping or packaging contents comprising the steps of procuring container wall components comprising sheet plastics material, arranging the components so that selected marginal portions are in substantial alignment, but spaced apart from one another by a distance, extruding a plastic strip from a V-shaped or W-shaped orifice of an extrusion die, said extruded strip being formed of a plastic material more flexible than the material of the wall components and having a plastic memory, said strip having a V-shaped or W-shaped cross-section corresponding to the V-shaped or W-shaped orifice of said extrusion die, and outer lengthwise extending margins proximate the edges thereof; and securing said outer lengthwise extending margins of portions of said strip to the selected marginal portions of the wall components by a bonding technique to form a gusset.

2. A method as claimed in claim 1, wherein the bonding technique is dielectric heating.

3. A method as claimed in claim 1, wherein the bonding technique is an adhesive bonding step.

4. A method according to claim 1, wherein the step of forming the strip of extruded plastics material includes forming the strip with excess marginal material, and trimming the excess marginal material after the bonding step.

5. A method according to claim 4, including the further step of joining three portions of extruded strip by welding at mitred corners thereof to form a gusset on three sides of a rectangular wall component.

6. A method as claimed in claim 5, wherein the step of procuring container wall components includes the step of providing three or more wall components and two or more intervening gussets.

* * * * *